US010016973B2

(12) United States Patent
Ozawa

(10) Patent No.: US 10,016,973 B2
(45) Date of Patent: Jul. 10, 2018

(54) PRINTING APPARATUS, PRINTING METHOD, AND COMPUTER PROGRAM

(71) Applicant: SEIKO EPSON CORPORATION, Tokyo (JP)

(72) Inventor: Hirohisa Ozawa, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/461,821

(22) Filed: Mar. 17, 2017

(65) Prior Publication Data

US 2017/0282542 A1 Oct. 5, 2017

(30) Foreign Application Priority Data

Mar. 30, 2016 (JP) ..... 2016-067504

(51) Int. Cl.
*B41J 2/045* (2006.01)
*B41J 2/21* (2006.01)
*B41J 2/205* (2006.01)

(52) U.S. Cl.
CPC ..... *B41J 2/04508* (2013.01); *B41J 2/04586* (2013.01); *B41J 2/2056* (2013.01); *B41J 2/2103* (2013.01); *B41J 2/2107* (2013.01)

(58) Field of Classification Search
CPC . B41J 2/2103; B41J 2/21; B41J 2/2107; B41J 2/2132; B41J 2002/2058; B41J 2/04508; B41J 2/04586
See application file for complete search history.

(56) References Cited

U.S. PATENT DOCUMENTS 7,016,530 B2 * 3/2006 Saito ..... H04N 1/6025 358/2.1
7,773,258 B2 * 8/2010 Tsuchiya ..... H04N 1/54 358/1.9

FOREIGN PATENT DOCUMENTS

JP 2011-168661 A 9/2011
JP 2013-018155 A 1/2013

* cited by examiner

*Primary Examiner* — Thinh H Nguyen

(57) ABSTRACT

A printing apparatus includes a first nozzle which ejects first ink containing a black coloring material, a second nozzle which ejects second ink with a low content rate of the coloring material compared to the first ink, and a control unit which controls ejecting of the ink from the first and second nozzles, in which, in a case of printing a darkest point, the control unit causes the second ink to be ejected after causing the first ink to be ejected, and causes the second ink to be ejected from the second nozzle so that a use rate of the second ink becomes 1% or more and 15% or less, when causing the second ink to be ejected.

5 Claims, 7 Drawing Sheets

PRINTING APPARATUS, PRINTING METHOD, AND COMPUTER PROGRAM

BACKGROUND

1. Technical Field

The present invention relates to a printing apparatus.

2. Related Art

Printing of an image on glossy paper of which the surface has high smoothness is performed using a printing apparatus such as an ink jet printer. In such printing, in order to improve durability of a printed image, pigment ink is used in many cases. In an image printed using the pigment ink, there is a case in which a so-called bronze phenomenon which exhibits glare such as metallic luster, or in which reflected light is visually recognized as a color different from the original pigment color depending on a viewing angle occurs. In order to suppress such a bronze phenomenon, a technology of ejecting a colorless, milky white, or white liquid compound including resin fine particles (hereinafter, referred to as "clear ink") separately from the pigment ink (refer to JP-A-2013-18155) has been proposed.

As described above, in the technology of ejecting clear ink separately from pigment ink, it is necessary to prepare an exclusive nozzle for ejecting clear ink in a printing head, and there is a problem in that a manufacturing cost of a printing apparatus increases compared to a configuration of not including the exclusive nozzle. The problem is not limited to a case of performing printing on glossy paper, and also can occur when printing an image on a printing medium of another type. For this reason, a technology which can suppress an occurrence of a bronze phenomenon while suppressing a rise in manufacturing cost of a printing apparatus is desired.

SUMMARY

The invention can be realized in the following aspects.

(1) According to an aspect of the invention, there is provided a printing apparatus which prints an image on a printing medium based on image data. The printing apparatus includes a first nozzle which ejects first ink containing a black coloring material; a second nozzle which ejects second ink with a low content rate of the coloring material compared to the first ink; and a control unit which controls ejecting of the first ink from the first nozzle, and ejecting of the second ink from the second nozzle, in which, in a case of printing a darkest point, the control unit causes the second ink to be ejected from the second nozzle after causing the first ink to be ejected from the first nozzle, and causes the second ink to be ejected from the second nozzle so that a use rate of ink which is a ratio of ejected weight of the second ink ejected per unit area to a total weight of the second ink in a case in which the second ink is ejected to all of pixels included in the unit area of the printing medium becomes 1% or more and 15% or less.

According to the printing apparatus, in a case of printing the darkest point, the second ink is ejected after the first ink is ejected, and since the second ink is ejected so that a use rate of ink at the time, that is, a ratio of ejected weight of the second ink ejected per unit area to a total weight in a case in which the second ink is ejected to all of pixels in the unit area becomes 1% or more and 15% or less, it is possible to suppress an occurrence of the bronze phenomenon. In addition, since ink with a low content rate of a black coloring material compared to that of the first ink is ejected as the second ink, it is possible to express a light black color using the second ink. Accordingly, it is not necessary to prepare an exclusive mechanism for ejecting a special liquid, and it is possible to suppress a rise in manufacturing cost of the printing apparatus compared to a configuration of ejecting the special liquid which does not contribute to an expression of a color of an image, for example, clear ink.

(2) In the printing apparatus, the control unit may cause the second ink to be ejected from the second nozzle so that a use rate of the ink becomes 3% or more and 15% or less when causing the second ink to be ejected from the second nozzle after causing the first ink to be ejected from the first nozzle. According to the printing apparatus in the aspect, since the second ink is ejected so that a use rate of the ink becomes 3% or more and 15% or less when the second ink is ejected after the first ink is ejected, it is possible to express a darker black color in a printed image compared to a configuration in which the second ink is ejected so that a use rate of the ink become 1% or more and less than 3%.

(3) In the printing apparatus, the control unit may cause the second ink to be ejected from the second nozzle so that a use rate of ink become 5% or more and 9% or less when causing the second ink to be ejected from the second nozzle after causing the first ink to be ejected from the first nozzle. According to the printing apparatus in the aspect, since the second ink is ejected so that a use rate of the ink becomes 5% or more and 9% or less when the second ink is ejected after the first ink is ejected, it is possible to express a darker black color in a printed image compared to a configuration in which the second ink is ejected so that a use rate of the ink become 1% or more and less than 5%, or a configuration in which the second ink is ejected so that a use rate of the ink become more than 9% and 15% or less.

All of a plurality of constituent elements which are included in the above described each embodiment of the invention is not essential, and it is possible to appropriately perform a change, a deletion, switching with another new constituent element, and a partial deletion of limited contents with respect to a part of the plurality of constituent elements, in order to solve a part or all of the above described problems, or achieve a part or all of effects which are described in the specification. In addition, by combining a part or all of technical features which are included in one aspect of the above described invention with a part or all of technical features which are included in another aspect of the above described invention, it is also possible to set one independent aspect of the invention, in order to solve a part or all of the above described problems, or achieve a part or all of effects which are described in the specification.

The invention can also be executed in various forms. For example, the invention can be executed in a form of a printing method, a control method of a printing apparatus, or a computer program for executing these methods, a recording medium which stores the computer program, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
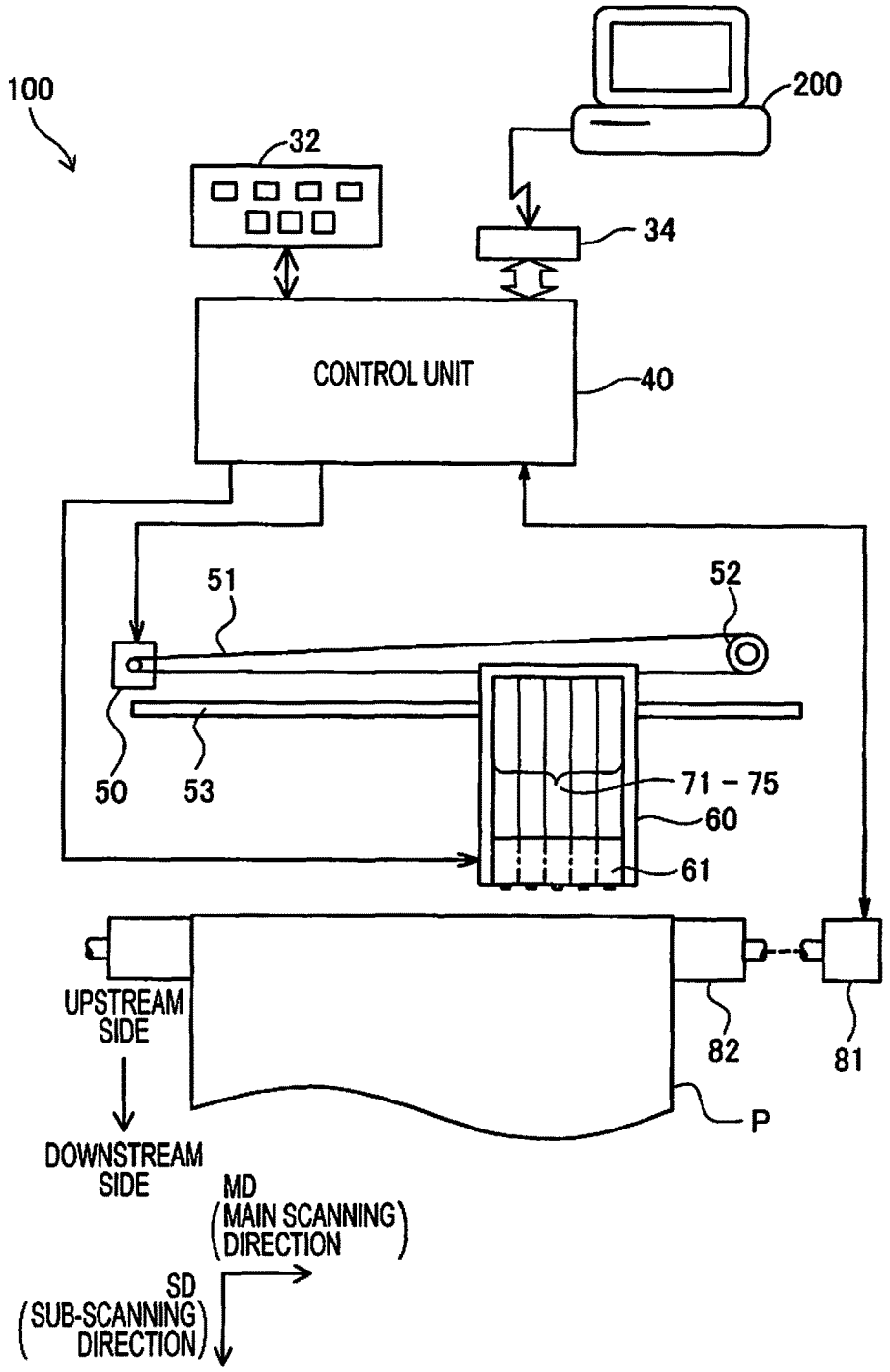
FIG. 1 is a block diagram which illustrates schematic configuration of a printing apparatus as one embodiment of the invention.

A1. Configuration of Apparatus:

FIG. 1 is a block diagram which illustrates a schematic configuration of a printing apparatus as one embodiment of the invention. A printing apparatus 100 prints an image on a printing medium P based on data (dot pattern data and control command which will be described later) received from a printing control device 200.

In the embodiment, the printing apparatus 100 is an ink jet printer, and forms an image by ejecting ink of 5 types in total onto the printing medium P. Ink ejected by the printing apparatus 100 is first ink to fifth ink. Specifically, the first ink corresponds to dark black (PK) ink. The second ink corresponds to light black (LK) ink, the third ink corresponds to Y (yellow) ink, the fourth ink corresponds to M (magenta) ink, and the fifth ink corresponds to C (Cyan) ink, respectively. A coloring material of each color is contained in all of the first to fifth ink. In the embodiment, each coloring material is pigment. Here, the second ink contains the same coloring material as that of the first ink. However, the second ink has a low content rate of a coloring material compared to that of the first ink. In the embodiment, a content rate of a coloring material of the second ink is a half of that of the first ink. In addition, the content rate is not limited to a half, and may be set to an arbitrary content rate which is lower than that of the first ink such as one fifth. The second ink is used for expressing a light black color, and is also used for suppressing an occurrence of the bronze phenomenon.

The printing apparatus 100 is provided with an operation panel 32, a connection interface unit 34, a control unit 40, a carriage motor 50, an endless driving belt 51, a pulley 52, a support rod 53, a carriage 60, a sheet feeding motor 81, and a sheet feeding roller 82.

The operation panel 32 receives a setting operation of a printing mode, or an instruction operation of various maintenance operations such as printing of a test pattern by a user. In addition, a display (not illustrated) is provided in the operation panel 32, and various menu screens, a status of the printing apparatus 100, and the like, are displayed thereon. The connection interface unit 34 is connected to the printing control device 200 through a predetermined cable, receives dot pattern data and a control command, which will be described later, transmitted from the printing control device 200, and delivers thereof to the control unit 40.

The control unit 40 controls the entire printing apparatus 100. For example, the control unit 40 controls a reciprocating operation of the carriage 60 along a main scanning direction MD, or a transport operation of the printing medium P along a sub-scanning direction SD, and controls ejecting of ink onto the printing medium P by driving a printing head 61 which is attached to the carriage 60, and which will be described later. In the embodiment, the main scanning direction MD and the sub-scanning direction SD are orthogonal to each other. In FIG. 1, an upstream side and a downstream side in the transport direction of the printing medium P are specified along the sub-scanning direction SD.

The carriage motor 50 causes the carriage 60 to reciprocate through the driving belt 51. The driving belt 51 is stretched between the carriage motor 50 and the pulley 52. The support rod 53 is a rod-like member which extends in parallel to the main scanning direction MD, and supports the carriage 60 so as to reciprocate along the main scanning direction MD.

The printing apparatus 100 is a so-called on carriage-type printer, and five ink cartridges in total of 71, 72, 73, 74, and 75 for each ink type are mounted in the carriage 60. In the embodiment, the first ink is accommodated in the ink cartridge 71, the second ink is accommodated in the ink cartridge 72, the third ink is accommodated in the ink cartridge 73, the four think is accommodated in the ink cartridge 74, and the fifth ink is accommodated in the ink cartridge 75, respectively.

In the carriage 60, the printing head 61 is attached to an end portion which faces the printing medium P. The printing head 61 is provided with a plurality of nozzles (nozzle nz which will be described later), and causes ink accommodated in each ink cartridge 71 to 75 to be ejected from nozzles according to an instruction from the control unit 40.

Figure 2:
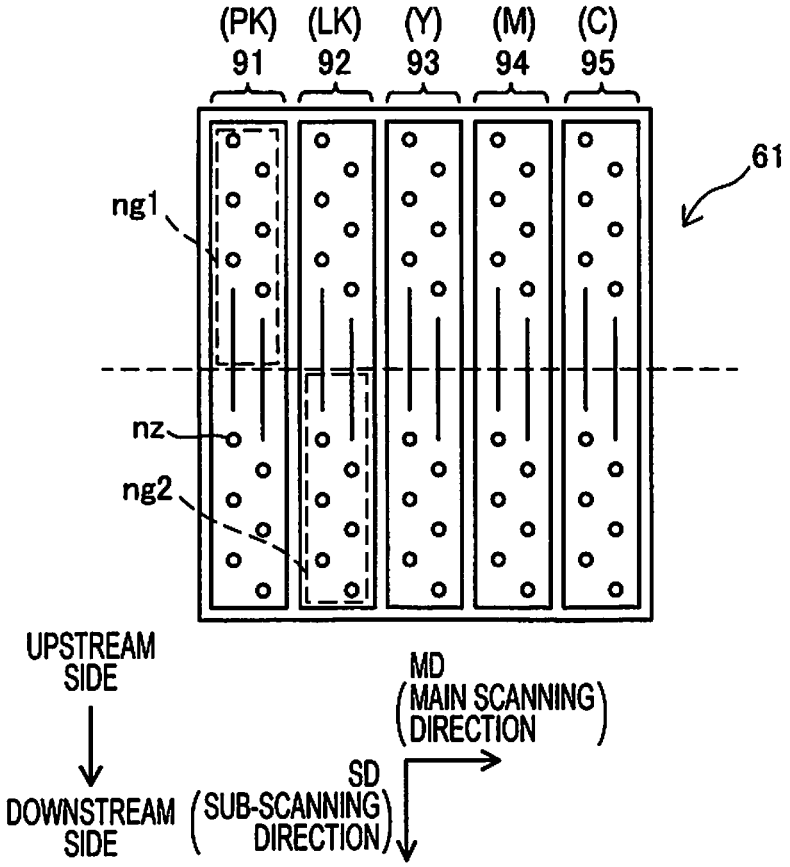
FIG. 2 is an explanatory diagram which illustrates an arranging state of nozzles which are provided in a printing head.

FIG. 2 is an explanatory diagram which illustrates an arranging state of nozzles provided in the printing head 61. FIG. 2 illustrates a face in the printing head 61 which faces the printing medium P. As illustrated in FIG. 2, a nozzle group for each ink type is provided on the face in the printing head 61 which faces the printing medium P. Specifically, a nozzle group 91 which ejects the first ink, a nozzle group 92 which ejects the second ink, a nozzle group 93 which ejects the third ink, a nozzle group 94 which ejects the fourth ink, and a nozzle group 95 which ejects the fifth ink are aligned in order from the left side in the figure along the main scanning direction MD. All of each of the nozzle groups 91 to 95 are configured of two nozzle columns formed of the plurality of nozzles nz which align at predetermined intervals along the sub-scanning direction SD. According to the embodiment, in the nozzle group 91, only a nozzle group ng1 which is located on the upstream side is used in ejecting of the first ink, and a nozzle group on the downstream side is not used in ejecting of the first ink. In addition, in the nozzle group 92, only a nozzle group ng2 which is located on the downstream side is used in ejecting of the second ink, and a nozzle group on the upstream side is not used in ejecting of the second ink. Each nozzle nz included in the nozzle group ng1 corresponds to a subordinate concept of the first nozzle in claims, and a nozzle nz included in the nozzle group ng2 corresponds to a included in the nozzle group ng1 corresponds to a subordinate concept of the second nozzle in claims, respectively.

Figure 3:
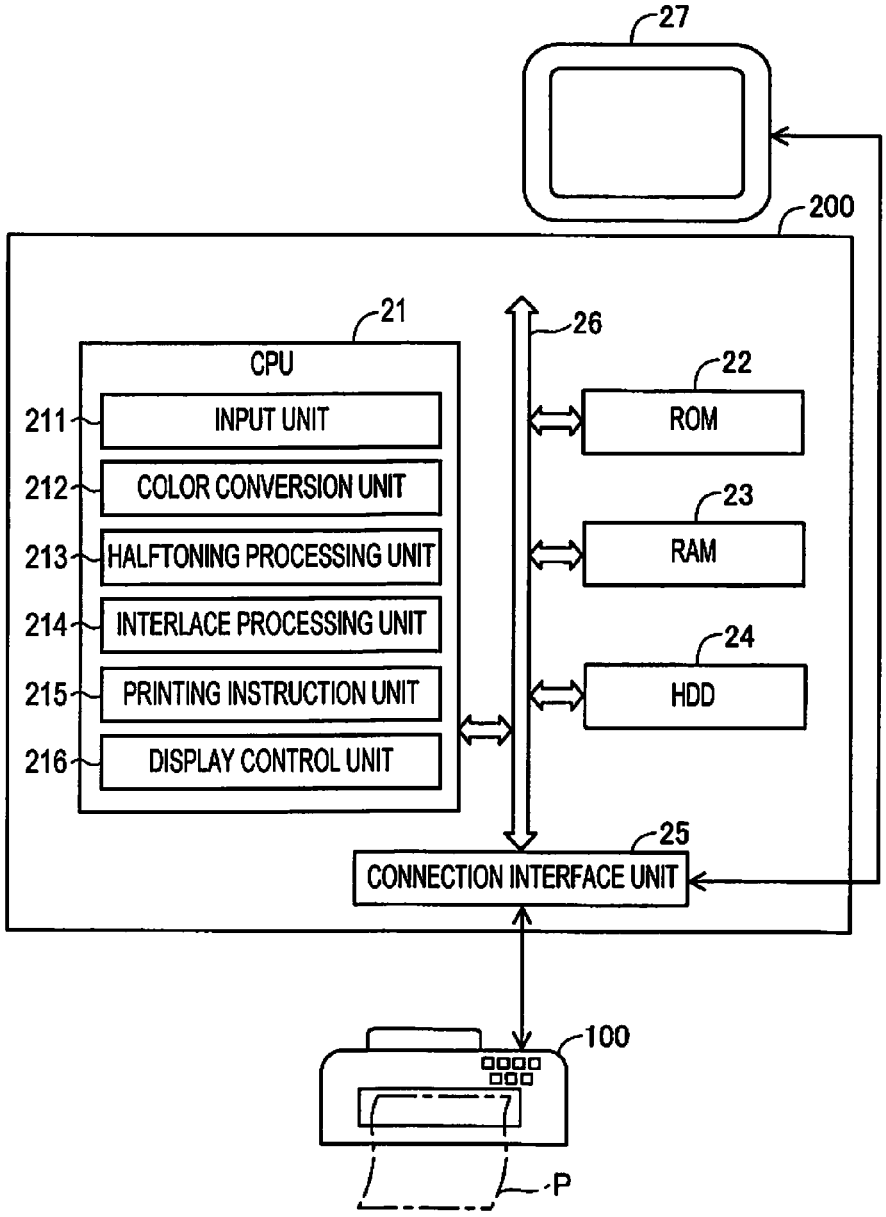
FIG. 3 is a block diagram which illustrates a schematic configuration of a printing control device.

FIG. 3 is a block diagram which illustrates a schematic configuration of the printing control device 200. In the embodiment, the printing control device 200 is configured of a computer. The printing control device 200 is provided with a CPU 21, a ROM 22, a RAM 23, a hard disk drive 24, and a connection interface unit 25. All of the CPU 21, the ROM 22, the RAM 23, the hard disk drive 24, and the connection interface unit 25 are connected to an internal bus 26, and can transmit and receive data to and from each other. The above described printing apparatus 100 and a display device 27 are connected to the printing control device 200 through the connection interface unit 25.

In the printing control device 200, various computer programs such as a control program, a printer driver for the printing apparatus 100, and a video driver are executed based on a predetermined operating system, and the CPU 21 functions as an input unit 211, a color conversion unit 212, a halftoning processing unit 213, an interlace processing unit 214, a printing instruction unit 215, and a display control unit 216 when theses computer programs are developed and executed in the RAM 23. The above described various computer programs are stored in the ROM 22 or the hard disk drive 24 in advance. In addition, it may be a configuration in which the various computer programs are stored in advance in a recording medium such as a CD-ROM or a memory card, instead of being stored in the ROM 22 or the hard disk drive 24 in advance, the recording medium is inserted into a media drive (not illustrated) which is included in the printing control device 200, and the various computer programs are read from the recording medium.

The input unit 211 inputs image data through an input-output interface (not illustrated), and stores the image data in the ROM 22 or the hard disk drive 24. According to embodiment, data formed of each grayscale value of R (red), G (green), and B (blue) (hereinafter referred to as "RGB data") is included in the image data. The color conversion unit 212 converts the RGB data included in the image data into data formed of each grayscale value of an ink color (PK, LK, Y, M, and C) which is used in the printing apparatus 100 (hereinafter, referred to as "ink color data"). The halftoning processing unit 213 performs halftoning processing in which a grayscale value of the ink color data is reduced to a grayscale value which can be expressed by forming dots. According to the embodiment, the halftoning processing is performed, using an error diffusion method. The interlace processing unit 214 performs a so-called interlace processing of rearranging into dot pattern data which illustrates a dot column which is formed in main scanning of once of the carriage 60 in the printing apparatus 100 based on data after the halftoning processing. The printing instruction unit 215 transmits the dot pattern data obtained by the interlace processing to the printing apparatus 100 along with a control command. The display control unit 216 causes the display device 27 to display an image based on image data, or various menu screens.

In the printing apparatus 100 including the above described configuration, it is possible to print an image, and suppress an occurrence of a bronze phenomenon in a black color region of the image by executing printing processing which will be described later. The bronze phenomenon means a phenomenon which exhibits glare such as metallic luster, or in which reflected light is visually recognized as a color different from the original color depending on an observing angle.

Figure 4:
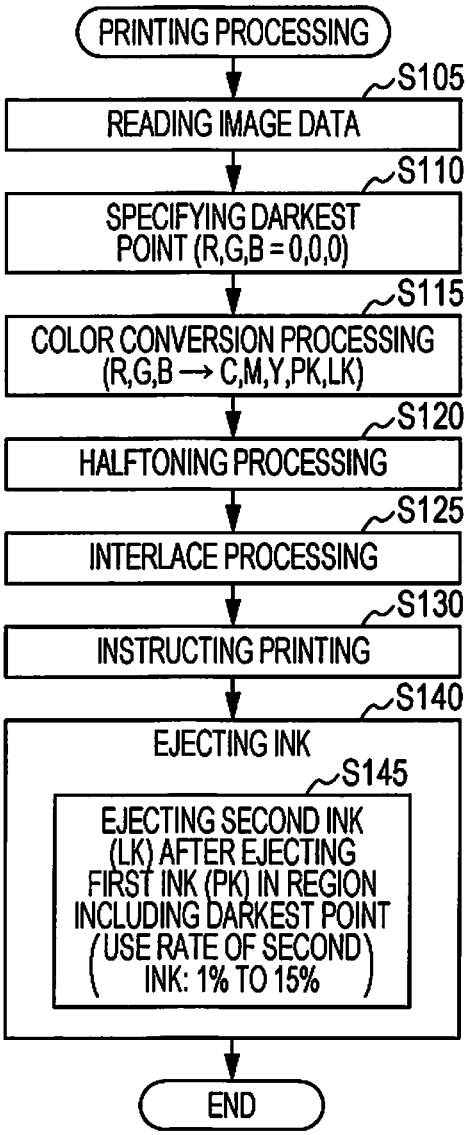
FIG. 4 is a flowchart which illustrates a procedure of printing processing according to a first embodiment.

A2. Printing Processing:

FIG. 4 is a flowchart which illustrates a procedure of printing processing in the first embodiment. When a user instructs an execution of printing by designating an image as a printing target in the printing control device 200, printing processing is executed in the printing control device 200 and the printing apparatus 100.

In the printing control device 200, the input unit 211 reads image data which is designated by a user (step S105). The input unit 211 reads image data stored in a recording medium such as the hard disk drive 24, a CD-ROM, or a memory card, for example.

The input unit 211 specifies a darkest point of a designated image based on image data (RGB data) which is read in step S105 (step S110). In the embodiment, the darkest point means a pixel which is expressed by R, G, B=0, 0, 0.

The color conversion unit 212 converts RGB data into ink color data by performing color conversion processing (step S115). At this time, the darkest point (R, G, B=0, 0, 0) is converted so as to be expressed by a dot which is formed so that dots of the first ink are 98%, and a total of dots of the third ink to fifth ink is 1%. In addition, in step S115, color conversion is executed so that the second ink is ejected at a predetermined use rate of ink in a region including the darkest point. In the embodiment, the above described "region including the darkest point" means a region which is formed in a predetermined shape (circle, rectangular shape, or the like) which includes all of dots (dot group) for expressing the darkest point. In addition, a region which includes at least a part of the dots (dot group) for expressing the darkest point such as a region formed in a predetermined shape including a part of dots (dot group) for expressing the darkest point, or a region which is specified by connecting dots located at the outer periphery in the dot (dot group) for expressing the darkest point may be used instead of the region. The above described "use rate of ink" means a ratio of ejected weight of the second ink ejected per unit area of the printing medium P to a total weight of the second ink in a case of ejecting the second ink to all of pixels included in the unit area. According to the embodiment, the "predetermined use rate of ink" is 1% or more and 15% or less. By setting the use rate of ink to 1% or more and 15% or less, it is possible to suppress an occurrence of the bronze phenomenon in a printed image. It is preferable to set the use rate of ink to 3% or more and 15% or less. The reason for this is that it is possible to express a region including the darkest point so as to be darker black by setting the use rate of ink to be in such a range. It is more preferable to set the use rate of ink to 5% or more and 9% or less. The reason for this is that it is possible to express the region including the darkest point so as to be darker black by setting the use rate of ink to be in such a range.

The half toning processing unit 213 executes half toning processing with respect to ink color data obtained in step S115 (step S120). The interlace processing unit 214 executes interlace processing with respect to data after being subjected to the processing in step S120 (step S125). The printing instruction unit 215 gives a printing instruction by transmitting the dot pattern data and the control command obtained in step S125 to the printing apparatus 100 (step S130). At this time, information related to a position of the darkest point which is specified in step S110 is included in the control command, specifically, a dot order in the dot pattern data which denotes a position of dots (dot group) for expressing the darkest point is transmitted by being included in the control command.

In the printing apparatus 100, the control unit 40 executes ink ejecting processing (step S140), based on dot pattern data and the control command included in the printing instruction from the printing control device 200, and the printing processing is finished. At this time, the control unit 40 controls a reciprocating operation of the carriage 60, a transport operation of the printing medium P, and the ink ejecting operation of the printing head 61. The ink ejecting processing (step S140) includes the following step S145. That is, the control unit 40 causes the second ink (LK) to be ejected after causing the first ink (PK) to be ejected to the region including the darkest point (step S145). For example, the nozzle group ng1 on the upstream side in the nozzle group 91 of the first ink illustrated in FIG. 2 ejects the first ink in a certain pass (any one of going movement and return movement in main scanning direction), and the nozzle group ng2 on the downstream side in the nozzle group 92 ejects the second ink to a region in which the first ink is ejected in the subsequent pass. Due to such an operation, the above described step S145 is executed. At this time, a use rate of the second ink become 1% or more and 15% or less, and an occurrence of the bronze phenomenon is suppressed in an image on the printing medium P in which printing is finished.

It is assumed that the reason why it is possible to suppress an occurrence of the bronze phenomenon by ejecting the second ink at a predetermined use rate after ejecting the first ink is as follows. In the region including the darkest point, dots of the second ink are formed on a layer formed of dots which are formed, using the first ink, and dots formed, using the third ink to fifth ink (hereinafter, referred to as "dark black layer"). It is assumed that the portion is expressed so as to be dark, that is, expressed so as to be black, and an occurrence of the bronze phenomenon can be suppressed, since phases are shifted between light reflected on the surface of the dots and light reflected on the dark black layer by penetrating the dots, in light radiated to the dots of the second ink.

According to the above described printing apparatus 100 in the first embodiment, in a case of printing the darkest point, it is possible to suppress an occurrence of the bronze phenomenon in a printed image since the second ink is ejected after the first ink is ejected, and a use rate of ink at that time, that is, a ratio of ejected weight of the second ink which is ejected per unit area to a total weight in a case in which the second ink is ejected to all of pixels in the unit area becomes 1% or more and 15% or less. In addition, since ink of which a content rate of a black coloring material is lower than that of the first ink is ejected as the second ink, it is possible to express a light black color using the second ink. Accordingly, it is not necessary to prepare an exclusive mechanism for ejecting special liquid, and it is possible to suppress a rise in manufacturing cost of a printing apparatus 100 compared to a configuration of ejecting special liquid which does not contribute to an expression of an image color, for example, clear ink.

In addition, it is set so that the second ink is ejected after ejecting the first ink, by setting so that the second ink is ejected in the subsequent pass of a pass in which the first ink is ejected. For this reason, it is possible to suppress an occurrence of a shift in ink ejecting position of the second ink, compared to a configuration in which only the second ink is ejected when transporting the printing medium P again by feeding back the printing medium P, after forming dots which are to be formed by using the first ink, and the third to the fifth ink, except for the second ink. In addition, it is possible to suppress a situation in which a sheet feeding roller 82, a platen (not illustrated), or the like, gets dirty due to dots which are formed on the printing medium P immediately after performing printing when feeding back the printing medium P.

B. Second Embodiment

Figure 5:
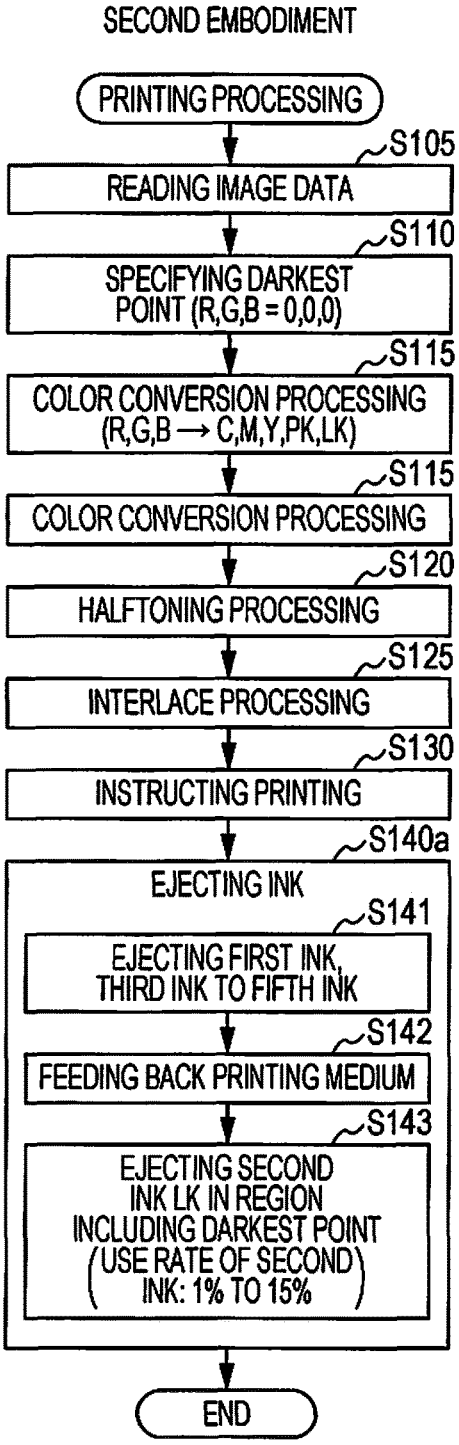
FIG. 5 is a flowchart which illustrates a procedure of printing processing according to a second embodiment.

FIG. 5 is a flowchart which illustrates a procedure of printing processing in a second embodiment. Since configurations of the printing apparatus and the printing control device in the second embodiment are the same as those in the printing apparatus 100 and the printing control device 200 in the first embodiment, the same reference numerals are attached to the same configurations, and detailed descriptions thereof will be omitted. Printing processing in the second embodiment is different from that in the first embodiment illustrated in FIG. 4, in a point that step S140*a* is executed instead of step S140. Since the other procedures in the printing processing in the second embodiment are the same as those in the first embodiment, the same reference numerals are attached to the same procedure, and detailed descriptions thereof will be omitted.

As illustrated in FIG. 5, in step S140*a* which is executed after step S130, steps S141, S142, and S143 which will be described later are executed instead of the above described step S145.

In the printing apparatus 100, the control unit 40 causes ink other than the second ink (first ink, and third ink to fifth ink) to be ejected from the printing head 61 based on the dot pattern data and the control command which are included in the printing instruction from the printing control device 200 (step S141). At this time, the control unit 40 controls the reciprocating operation of the carriage 60, and the transport operation of the printing medium P. In step S141, the first ink is ejected, using all of the nozzles of the nozzle group 91 of the first ink, differently from step S145 in the first embodiment.

In the printing apparatus 100, the control unit 40 feeds back the printing medium P to the upstream side from the downstream side along the sub-scanning direction SD, by reversely driving the carriage motor 50 (step S142). In step S142, the reciprocating operation of the carriage 60 and ink ejecting operation of the printing head 61 are not executed.

In the printing apparatus 100, the control unit 40 causes the second ink to be ejected to a region including the darkest point based on the dot pattern data and the control command included in the printing instruction from the printing control device 200 (step S143). In step S143, the second ink is ejected, using all of the nozzles of the nozzle group 92 of the second ink, differently from step S145 in the first embodiment.

In the above described printing apparatus 100 in the second embodiment, it is possible to suppress an occurrence of the bronze phenomenon due to a black color region, similarly to the printing apparatus 100 in the first embodiment.

C. Examples

C1. First Example

Printing of a predetermined image was executed according to the above described first and second embodiments, and an effect of suppressing the bronze phenomenon in the obtained printed image was confirmed. Brightness (L value) in each angle was measured by a multiangle measuring instrument with respect to the printed image, and the effect of suppressing the bronze phenomenon was evaluated based on angular dependence thereof. Specifically, the effect of suppressing the bronze phenomenon was evaluated as a low effect when a degree of change in L value with respect to a change in angle in the vicinity of a peak of brightness is high, that is, when angular dependence of brightness is high. In addition, the effect of suppressing the bronze phenomenon was evaluated as a high effect when the degree is low, that is, when the angular dependence of brightness is low.

The reason for this is that, when the degree of change in L value with respect to a change in angle in the vicinity of the peak of brightness (L value) is high, the color visually recognized depending on an observing angle is easily changed, and the bronze phenomenon easily occurs. As the multiangle measuring instrument, spectrophotometric variable angle color difference meter (GC 5000) made by Nippon Denshoku Co., Ltd. was used. A colorimetry angle was fixed to 45°, and colorimetry was performed by changing irradiation angle of light by 5° from +5° to 70°. In addition, as the printing medium P, glossy paper (EPSON photographic paper <glossy> made by Seiko Epson Corporation) was used.

As a comparison example, printing of a predetermined image was executed. In the comparison example, ejecting of the second ink (LK) was not performed. That is, a region including the darkest point was expressed, using dots which are formed of only other ink (first ink, and third to fifth ink) than the second ink. In addition, angular dependence was obtained, using brightness of the above described multiangle measuring instrument with respect to a printed image of the comparison example, and the effect of suppressing the bronze phenomenon was evaluated.

Figure 6:
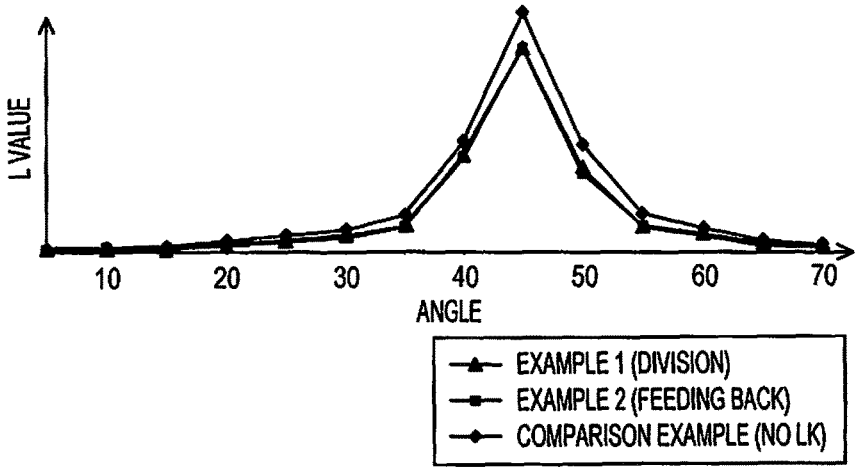
FIG. 6 is an explanatory diagram which illustrates angular dependence of brightness in a printed image in an example and a comparison example.

FIG. 6 is an explanatory diagram which illustrates angle dependency of brightness in printed images of the example and the comparison example. In FIG. 6, a horizontal axis denotes an irradiation angle of light, and a vertical axis denotes brightness (L value). In FIG. 6, a graph formed of black triangular measuring points denotes a brightness value of a printed image obtained according to the first embodiment (hereinafter, referred to as "example 1"). In the first embodiment, since both of dots of the first ink (PK) and dots of the second ink (LK) are formed only by any one of the nozzle groups on the upstream side and the downstream side in respective nozzle groups 91 and 92, in FIG. 6, the brightness of the printed image in example 1 is denoted by "division". In FIG. 6, a graph formed of black rectangular measuring points denotes the brightness value of the printed image obtained according to the second embodiment (hereinafter, referred to as "example 2"). Since the printing medium P is fed back in the second embodiment, in FIG. 6, the brightness of the printed image in example 2 is denoted by "feedback". In FIG. 6, a graph formed of black rhombic measuring points denotes the brightness value of the printed image obtained according to the comparison example. In the comparison example, since the second ink (LK) is ejected, in FIG. 6, the brightness of the printed image obtained according to the second embodiment is denoted by "no LK".

As illustrated in FIG. 6, in printed images in all of example 1, example 2, and the comparison example, approximately the same angle (approximately 44°) becomes a peak of the L value. However, a degree of change in L value with respect to a change in angle in the comparison example, in the vicinity of the peak, is higher than that of the two examples (examples 1 and 2). In addition, the degree of change in L value is approximately the same as those in examples 1 and 2. With such a result, it is possible to evaluate that angular dependence of brightness (L value) is low compared to a printed image in the comparison example, and it is possible to suppress an appearance of bronze phenomenon in printed images of examples 1 and 2.

Printing processing was performed separately from the above described experiment, according to the first embodiment using new sixth ink (LLK) of which a content rate of a black coloring material is lower than that of the second ink, instead of the second ink, and a printed image was obtained. In addition, angle dependency was obtained, using brightness of the above described multiangle measuring instrument with respect to the printed image, and an effect of suppressing the bronze phenomenon was evaluated. As the printing medium P, the same glossy paper as that in the experiment related to FIG. 6 was used.

Figure 7:
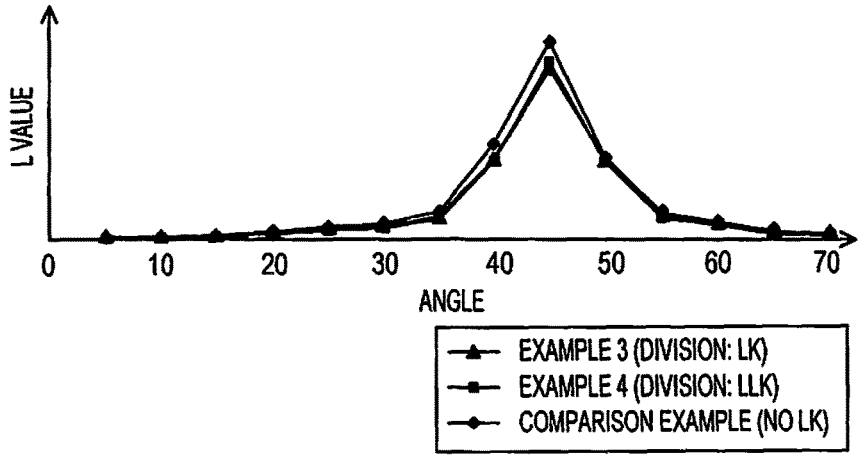
FIG. 7 is an explanatory diagram which illustrates angular dependence of brightness in a printed image in an example and a comparison example.

FIG. 7 is an explanatory diagram which illustrates angular dependence of brightness in printed images of examples and a comparison example. In FIG. 7, a graph formed of black triangular measuring points denotes a brightness value of a printed image obtained according to the first embodiment (hereinafter, referred to as "example 3") using the second ink (LK). In FIG. 7, a graph formed of black rectangular measuring points denotes a brightness value of a printed image obtained according to the first embodiment using the sixth ink (LLK) (hereinafter, referred to as "example 4"). In FIG. 7, a graph formed of black rhombic measuring points denotes a brightness value of a printed image obtained according to the comparison example. A printed image in example 3 was obtained similarly to the printed image in the above described example 1. The printed image of the comparison example in FIG. 7 was obtained similarly to that in the above described comparison example in FIG. 6.

As illustrated in FIG. 7, similarly to that in FIG. 6, a degree of change in L value with respect to a change in angle in the vicinity of a peak in the comparison example is high compared to those in the two examples (examples 3 and 4). Accordingly, in examples 3 and 4, it is possible to evaluate that an occurrence of the bronze phenomenon was suppressed compared to the comparison example, similarly to the above described examples 1 and 2. In addition, degree of changes in L value with respect to the change in angle in the vicinity of the peak of the two examples (examples 3 and 4) are approximately the same as each other. Accordingly, it is understood that a difference in content rates of coloring materials between examples 3 and 4 does not remarkably contribute to the effect of suppressing the bronze phenomenon.

C2. Second Example

Printing of a predetermined image was executed according to the above described first embodiment. At this time, a plurality of printed images were obtained by performing respective printing, by setting use rates of ink to be different from each other. The use rate of ink was changed by 1% between 1% and 15%. As a comparison example, printing was executed even when a use rate of ink is 0%. In addition, density of a black color (OD value: value of optical density) in a black color region (region including darkest point) in printed images which are respectively obtained was measured. In the OD value, an exclusive colorimetric device for OD (DensiEye) made by X-Rite Inc. was used. In addition, as the printing medium P, glossy paper (EPSON photographic paper <glossy> made by Seiko Epson Corporation) was used. A range of a use rate of ink in which it is possible to express a denser black color (darker black) was specified from a relationship between the use rate of ink and the OD value.

Figure 8:
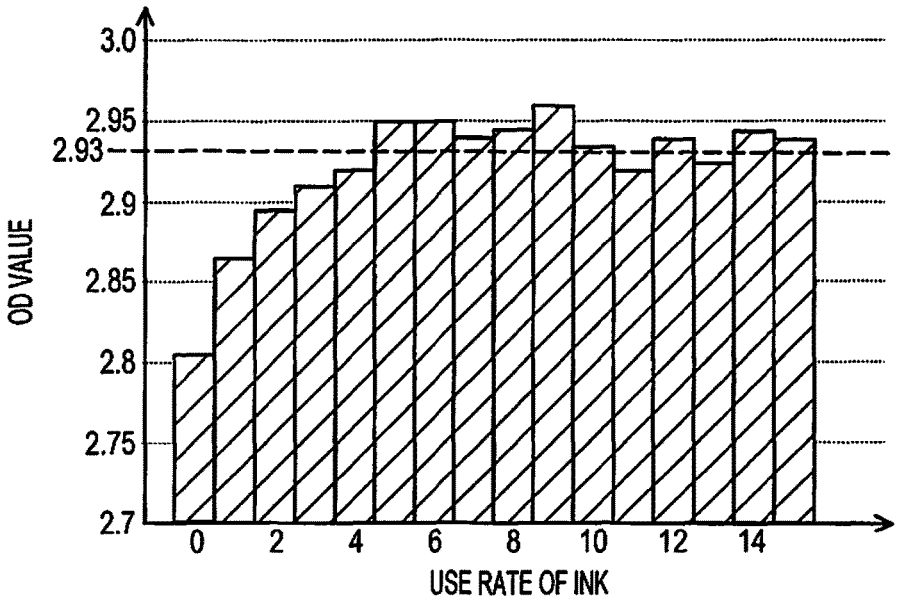
FIG. 8 is an explanatory diagram which illustrates a relationship between a use rate of ink and an OD value.

FIG. 8 is an explanatory diagram which illustrates a relationship between the use rate of ink and the OD value. In FIG. 8, a horizontal axis denotes the use rate of ink, and a vertical axis denotes the OD value. As illustrated in FIG. 8, in a case in which the use rate of ink is 1% or more and 15% or less, the OD value is high compared to a case in which the use rate of ink is 0%. Specifically, in a case in which the use rate of ink is 1% or more and 15% or less, the OD value is 2.85 or more; however, in contrast to this, in a case in which the use rate of ink is 0%, the OD value is lower than 2.85. From this, when the use rate of ink is 1% or more and 15% or less, it is possible to express a denser black color compared to a case in which the use rate of ink is lower than 1%.

In a case in which the use rate of ink is 3% or more and 15% or less, the OD value becomes 2.9 or more, it is possible to express a dense black color compared to a case in which the use rate of ink is less than 3%, and it is more preferable. In addition, in a case in which the use rate of ink is 5% or more and 9% or less, the OD value becomes approximately 2.93 or more, and is much more high. For this reason, it is possible to express a denser black color in a printed image, and is more preferable compared to a case in which the use rate of ink is 1% or more and less than 5%, or a case in which the use rate of ink is higher than 9% and 15% or less.

D. Modification Examples

D1. Modification Example 1

In each embodiment, the control unit 40 is provided with the printing apparatus 100; however, the printing control device 200 may be provided instead of the printing apparatus 100. In the configuration, the control unit in the printing apparatus 100 and the printing control device 200 corresponds to a subordinate concept of a printing apparatus in claims. In addition, in the configuration, the printing apparatus 100 may be provided with a control circuit which executes a control of other operations except for the reciprocating operation along the main scanning direction MD of the carriage 60, a transport operation of the printing medium P along the sub-scanning direction SD, and an ink ejecting operation using the printing head 61.

D2. Modification Example 2

In each embodiment, the printing apparatus 100 is an on-carriage type printer; however, the printer may be an off-carriage type printer, that is, a printer in which an ink tank is provided separately from the carriage 60, and ink is supplied to the printing head 61 from the ink tank using a tube, or the like. In addition, the printing apparatus 100 is a so-called serial printer in which the carriage 60 performs scanning in the main scanning direction MD; however, the invention is not limited to this. For example, the printer may be a line printer in which a printing head does not perform a scanning operation. It is possible to cause the second ink to be ejected after the first ink is ejected also in the line printer, by disposing a nozzle group which ejects the first ink on the upstream side in the sub-scanning direction SD, and disposing a nozzle group which ejects the second ink on the downstream side, for example. Also in such a configuration, it is possible to suppress an occurrence of the bronze phenomenon, similarly to each of the embodiments. In addition, the invention is not limited to a printer, and for example, an apparatus which prints an image on a printing medium based on image data such as a facsimile, a multi-function printer, or the like, for example, and may be applied to an arbitrary apparatus which forms an image by ejecting ink.

D3. Modification Example 3

In each embodiment, the second ink is ejected, in addition to the first ink as the black ink; however, the sixth ink may be ejected instead of the second ink, similarly to example 3. In addition, the sixth ink may be ejected, in addition to the second ink. Also in the configuration, the same effect as that in each embodiment is exhibited by ejecting the sixth ink after ejecting the first ink.

D4. Modification Example 4

In each embodiment, the darkest point in a designated image is specified by an RGB value based on image data (RGB data) which is read; however, it is not limited to the RGB value, and the darkest point may be specified by a grayscale value in another color space such as L*a*b, CMY, and HSV.

D5. Modification Example 5

A part of configuration which is executed by software in each of the above described embodiments may be substituted by hardware, and in contrast to this, a part of configuration which is executed by hardware may be substituted by software. In addition, in a case in which a part or all of functions in the invention is executed by software, the software (computer program) can be provided in a form of being stored in a computer readable recording medium. The "computer readable recording medium" is not limited to a portable recording medium such as a flexible disk or a CD-ROM, and also includes an internal storage device in a computer such as various RAMs or ROMs, or an external storage device which is fixed to a computer such as a hard disk. That is, the "computer readable recording medium" includes an arbitrary recording medium which can fix data, without storing data temporarily, in a wide sense.

The invention is not limited to the above described embodiments, examples, and modification examples, and can be executed in various configurations without departing from the scope of the invention. For example, technical features in the embodiments, examples, and modification examples which correspond to technical features in each embodiment described in summary of the invention can be appropriately replaced, or combined in order to solve a part or all of the above described problems, or to achieve a part or all of the above described effects. In addition, when the technical features are not explained as essential features in the specification, the features can be appropriately deleted.

This application claims priority under 35 U.S.C. § 119 to Japanese Patent Application No. 2016-067504, filed Mar. 30, 2016. The entire disclosure of Japanese Patent Application No. 2016-067504 is hereby incorporated herein by reference.

What is claimed is:

1. A printing apparatus which prints an image on a printing medium based on image data comprising:

a first nozzle which ejects first ink containing a black coloring material;

a second nozzle which ejects second ink containing the black coloring material, with a content rate of the black coloring material in the second ink being lower than a content rate of the black coloring material in the first ink; and a control unit which controls the first nozzle for ejecting the first ink, and controls the second nozzle for ejecting the second ink, the control unit controlling the second nozzle to eject the second ink after controlling the first nozzle to eject the first ink while printing an image area including a darkest point of the image on the printing medium, and the control unit further controlling the second nozzle to eject the second ink while printing the image area including the darkest point of the image on the printing medium such that an ink use rate which is a ratio of ejected weight of the second ink that is ejected per unit area of the printing medium while printing the image area including the darkest point of the image on the printing medium relative to a total weight of the second ink that is ejected in a case in which the second ink is ejected to all of pixels included in the unit area of the printing medium is 1% or more and 15% or less.

2. The printing apparatus according to claim 1, wherein the control unit further controls the second nozzle to eject the second ink such that the ink use rate is 3% or more and 15% or less while the control unit controls the second nozzle to eject the second ink after controlling the first nozzle to eject the first ink.

3. The printing apparatus according to claim 1, wherein the control unit further controls the second nozzle to eject the second ink such that the ink use rate is 5% or more and 9% or less while the control unit controls the second nozzle to eject the second ink after controlling the first nozzle to eject the first ink.

4. A printing method of printing an image on a printing medium based on image data using a printing apparatus which includes a first nozzle which ejects first ink containing a black coloring material, and a second nozzle which ejects second ink containing the black coloring material, with a content rate of the black coloring material in the second ink being lower than a content rate of the black coloring material in the first ink, the method comprising:

controlling the second nozzle to eject the second ink after controlling the first nozzle to eject the first ink while printing an image area including a darkest point of the image on the printing medium, the controlling of the second nozzle to eject the second ink including controlling the second nozzle to eject the second ink while printing the image area including the darkest point of the image on the printing medium such that an ink use rate which is a ratio of ejected weight of the second ink that is ejected per unit area of the printing medium while printing the image area including the darkest point of the image on the printing medium relative to a total weight of the second ink that is ejected in a case in which the second ink is ejected to all of pixels included in the unit area of the printing medium is 1% or more and 15% or less.

5. A non-transitory computer readable medium storing a program for printing an image on a printing medium based on image data using a printing apparatus which includes a first nozzle which ejects first ink containing a black coloring material, and a second nozzle which ejects second ink containing the black coloring material, with a content rate of the black coloring material in the second ink being lower than a content rate of the black coloring material in to the first ink, the program causing a computer to execute:

controlling the second nozzle to eject the second ink after controlling the first nozzle to eject the first ink while printing an image area including a darkest point of the image on the printing medium, the controlling of the second nozzle to eject the second ink including controlling the second nozzle to eject the second ink while printing the image area including the darkest point of the image on the printing medium such that an ink use rate which is a ratio of ejected weight of the second ink that is ejected per unit area of the printing medium while printing the image area including the darkest point of the image on the printing medium relative to a total weight of the second ink that is ejected in a case in which the second ink is ejected to all of pixels included in the unit area of the printing medium is 1% or more and 15% or less.

* * * * *